US005719765A

United States Patent [19]

Book

[11] Patent Number: 5,719,765

[45] Date of Patent: Feb. 17, 1998

[54] REAL-TIME SCROLLING DRIVE-TRACE DISPLAY FOR A VEHICLE ENGINE ANALYZER

[75] Inventor: Jeffrey J. Book, Streamwood, Ill.

[73] Assignee: Snap-on Technologies, Inc., Lincolnshire, Ill.

[21] Appl. No.: 511,889

[22] Filed: Aug. 7, 1995

[51] Int. Cl.[6] ..... G06G 7/76

[52] U.S. Cl. ..... 364/424.035; 364/424.034; 364/487; 324/379; 324/121 R; 345/121

[58] Field of Search ..... 364/424.028, 424.033, 364/424.034, 424.035, 424.036, 424.037, 424.038, 424.04, 431.04; 340/462, 438, 439, 441, 459, 461, 995, 9; 395/116, 346, 353, 357, 183.14, 183.22; 345/4, 125, 121, 150, 113, 133–135, 76, 140; 348/124, 725, 657, 808–809; 434/69, 65, 307 R, 373; 73/117, 116; 324/379, 393, 121 R

[56] References Cited

U.S. PATENT DOCUMENTS

| | | | |
|---|---|---|---|
| 3,990,302 | 11/1976 | Reeves et al. | 73/116 |
| 4,167,019 | 9/1979 | Shepperd | 348/725 |
| 4,441,359 | 4/1984 | Ezoe | 364/424.037 |
| 4,484,192 | 11/1984 | Seitz et al. | 340/995 |
| 4,543,572 | 9/1985 | Tanaka et al. | 364/449.2 |
| 4,689,616 | 8/1987 | Goude et al. | 345/113 |
| 4,706,199 | 11/1987 | Guerin | 364/460 |
| 4,943,968 | 7/1990 | Hirose et al. | 371/19 |
| 4,977,524 | 12/1990 | Strege et al. | 364/562 |
| 5,122,785 | 6/1992 | Cooper | 340/710 |
| 5,247,287 | 9/1993 | Tonker et al. | 364/431.04 |
| 5,272,769 | 12/1993 | Strnatka et al. | 364/424.034 |
| 5,305,219 | 4/1994 | Ishibashi et al. | 364/424.04 |
| 5,309,139 | 5/1994 | Austin | 340/462 |
| 5,354,202 | 10/1994 | Moncrief et al. | 434/69 |

*Primary Examiner*—Jacques Louis-Jacques
*Attorney, Agent, or Firm*—Emrich & Dithmar

[57] ABSTRACT

A method and apparatus for generating a horizontally-magnified, scrolling drive-trace line on a graphical display screen of an engine analyzer aids a technician in controlling a vehicle's speed over a fixed driving period of successive driving time intervals. Toward this end, an initial drive-trace line is displayed on the screen representing the ideal vehicle speed at which the technician should maintain the vehicle during a first set of successive driving time intervals. A movable iconic marker is displayed on the screen disposed along the displayed initial drive-trace line. The iconic marker is moved horizontally on the screen after each elapsed time interval until the marker reaches a predetermined position along the drive-trace line, after which time the drive trace line is scrolled. The scrolling process involves deleting a portion of a previous drive-trace line, redrawing the remaining drive-trace line on the screen shifted horizontally by a predetermined amount, and appending a new drive-trace line portion associated with a subsequent time interval to the remaining drive-trace line to create a scrolled drive-trace line after each elapsed time interval. In addition to the drive-trace line, upper and lower speed-limiting lines may also be provided to aid the technician in maintaining his speed within an allowable range.

22 Claims, 3 Drawing Sheets

REAL-TIME SCROLLING DRIVE-TRACE DISPLAY FOR A VEHICLE ENGINE ANALYZER

BACKGROUND OF THE INVENTION

1. Field of the Invention

The present invention relates to a method and apparatus for generating a scrolling, drive-trace graphical interface to aid a technician in maintaining a vehicle's speed within predefined limits during an emissions test.

2. Description of the Prior Art

Many countries require the certification of motor vehicles, especially with respect to engine emissions. In a typical test, a vehicle is connected to a dynamometer and an automotive technician accelerates and decelerates the stationary vehicle over a 240-second interval to simulate typical driving conditions. As time progresses and as engine speed is varied, an engine analyzer monitors and collects data on the emission output levels of the vehicle. During the test, the driver must stay as close as possible to a predefined government specification of driving speeds. Deviations of driving speeds either greater or lesser than predefined upper and lower speed limits will void the emissions test. It is therefore critical that the technician maintain his speed within the predefined, continuously variable, driving speed range.

Until now, as an aid to the technician controlling his speed, a graphical full-screen (non-moving) drive trace line was displayed on the analyzer monitor, which trace line the technician attempts to follow while changing speeds. A time-based trace of the vehicle's actual vehicle speed was superimposed over the recommended drive trace line. When the driver's trace deviated too greatly from the recommended trace line, the test was void and had to be repeated from the start. Prior drive trace patterns were difficult to use because they did not adequately assist the technician to anticipate upcoming speed changes. Also, because the entire 240-second drive trace pattern was displayed on a single (non-scrolling) screen, the drive trace was too small to read from a distance.

SUMMARY OF THE INVENTION

It is a general object of the invention to provide a scrolling graphical interface for communicating magnified, scrolling relative speed information to the technician, providing him with an improved visual display which would allow him to accelerate and decelerate the vehicle by an amount necessary to maintain vehicle speed within allowable limits.

This and other features of the present invention are attained by providing a method and apparatus for generating a horizontally-magnified, scrolling, drive-trace line on a graphical display screen of an engine analyzer to aid a technician in controlling a vehicle's speed over a fixed driving period of successive driving time intervals. The engine analyzer is of the type coupled to receive speed indicating signals from the vehicle or from a dynamometer coupled to the vehicle. An initial drive-trace line is displayed on the screen, the line representing the ideal vehicle speed at which the technician should maintain the vehicle to comply with the predetermined trace line during a first set of successive driving time intervals. The set of successive time intervals defines a window of driving time that is less than the duration of the driving period. A movable iconic marker is displayed on the screen disposed along the displayed initial drive-trace line. The vertical position of the iconic marker during an associated time interval is a function of the corresponding current vehicle speed. The iconic marker is moved horizontally on the screen after each elapsed time interval until the marker reaches a predetermined position along the drive-trace line, after which time the drive trace line is scrolled. The scrolling process involves deleting a portion of a previous drive-trace line, redrawing the remaining drive-trace line on the screen shifted horizontally by a predetermined amount, and appending a new drive-trace line portion associated with a subsequent time interval to the remaining drive-trace line to create a scrolled drive-trace line after each elapsed time interval. In addition to the drive-trace line, upper and lower speed-limiting lines may also be provided to aid the technician in maintaining his speed within an allowable range.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DETAILED DESCRIPTION OF THE PREFERRED EMBODIMENTS

Figure 1:
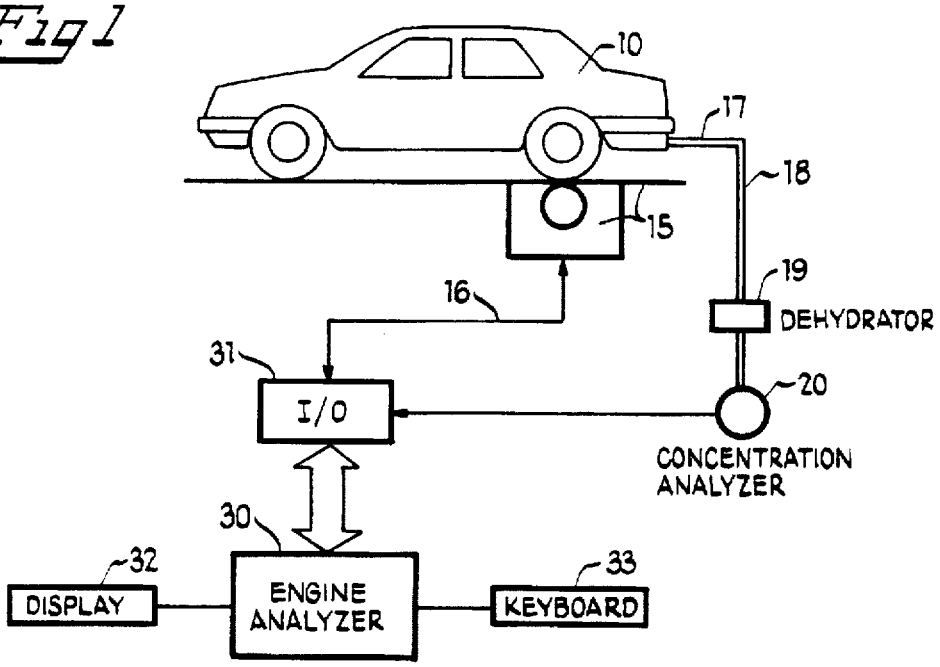
FIG. 1 is a diagrammatic illustration of a vehicle emission test system, including an engine analyzer coupled to a dynamometer for collecting vehicle speed readings during a 240-second emissions test.

Referring to FIG. 1, there is illustrated a vehicle emissions test system for use on a motor vehicle 10, coupled in a known manner to a chassis dynamometer 15 which is operable to simulate various driving conditions of the engine of the motor vehicle 10, as if it were being driven on an actual road. The engine of the vehicle 10 is controlled by a driver seated in the vehicle who will variably accelerate, decelerate and maintain cruising speeds, in an appointed sequence over a predefined and continuous driving period (usually a 240-second test period). During this driving period, the dynamometer 15 permits the vehicle wheels to be rotated in engagement with a surface while the vehicle is standing still, permitting the test to be conducted in a technician's shop.

The dynamometer 15 relates information of the vehicle's actual wheel (driving) speed to an engine analyzer 30 via communication link 16. The engine analyzer 30 is equipped with an I/O port 31, an appropriate monitor display 32 and may also include additional peripheral resources (not shown), such as printers and external memory, coupled thereto. Operator input commands and test parameters, such as will be explained below, are fed to the analyzer 30 via a keyboard 33 and stored in appropriate memory registers.

Reference numeral 17 designates an exhaust-gas-inlet passage for receiving gas exhausted from the vehicle 10 under test. During a typical emissions test, gas samples are led from the exhaust gas-inlet passage 17 through a sampling passage 18 for measurement of the concentration of each of various ingredient gases (CO, CO2, NOx, HC and the like). For this purpose, a dehydrator 19 is provided for dehydrating the exhaust gas at a specified temperature, the output thereof being fed to a concentration analyzer 20 which analyzes the exhaust gas to determine the concentration of each of one or more specified ingredient gases (the ingredient or ingredients to be measured). The measured ingredient gas concentration levels are then communicated to the engine analyzer 30 from the concentration analyzer 20, via the I/O port 31, and stored in assigned memory locations, all in a known manner.

The engine analyzer 30 takes data readings and performs necessary background test-related calculations over a 240-second simulated driving period at successive one-second, sampling time intervals, in accordance with current EPA emissions testing requirements. EPA rules presently require that all measurements be taken over a varying range of driving modes, such as acceleration, cruise and deceleration modes. In the illustrative embodiment, in order to maintain the vehicle speed within a varying allowable range during the test period, the technician is aided by a scrolling 240-second time-based drive-trace (see FIGS. 2–4) generated on the screen of display 32 in accordance with the present invention.

It should be understood that after test initiation, which includes properly connecting communication link 16 to the dynamometer 15, and the exhaust-gas-inlet passage 17 to the vehicle 10, and connecting dynamometer 15 to the engine analyzer 30, the technician, seated within the vehicle 10, will attempt to follow the scrolling graphical drive trace while changing speeds. A time-based trace of the vehicle's actual speed (shown by hash lines 60 in FIGS. 3 and 4) is simultaneously superimposed over the recommended scrolling drive trace to aid the technician in maintaining the vehicle speed within time-varying allowable vehicle speeds.

The engine analyzer 30 is essentially a microprocessor-based embedded controller system adapted to carry out multiple system functions, including controlling the operation of the dynamometer 15 in a conventional manner by way of the communication link 16 thereto, storing detected vehicle speed information and gas concentration levels for each of the predetermined successive intervals during the period the vehicle 10 is under test, and, in accordance with the present invention, generating the magnified, scrolling drive-trace display to aid the technician in appropriately varying the vehicle's speed.

The drive-trace display of the present invention will now be described with reference to FIGS. 2–4 which show various drive-trace screen displays, each corresponding to separate 30-second time interval frames, presented to the technician at appropriate times during the test. More specifically, FIG. 2 shows the initial 30-second screen display of the 240-second scrolling drive trace, FIG. 3 shows a 30-second screen display presented to the technician at approximately the middle of the 240-second scrolling drive trace, and FIG. 4 shows the final 30-second screen display of the 240-second scrolling drive trace.

Figure 2:
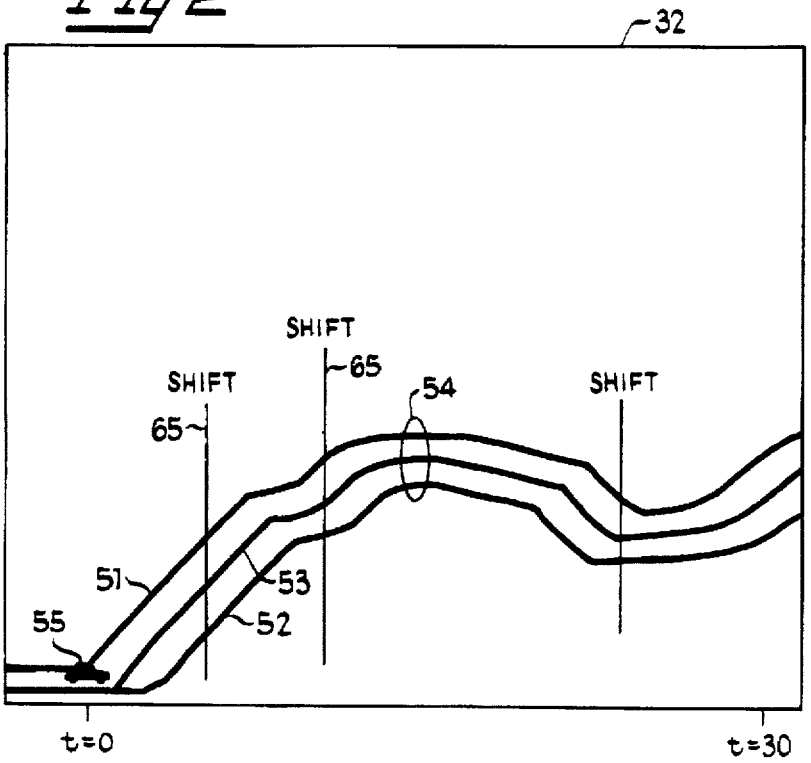
FIG. 2 shows an initial 30-second screen display of a 240-second scrolling drive trace presented—on the display of FIG. 1—to the technician seated in the vehicle during the emissions test.
Figure 3:
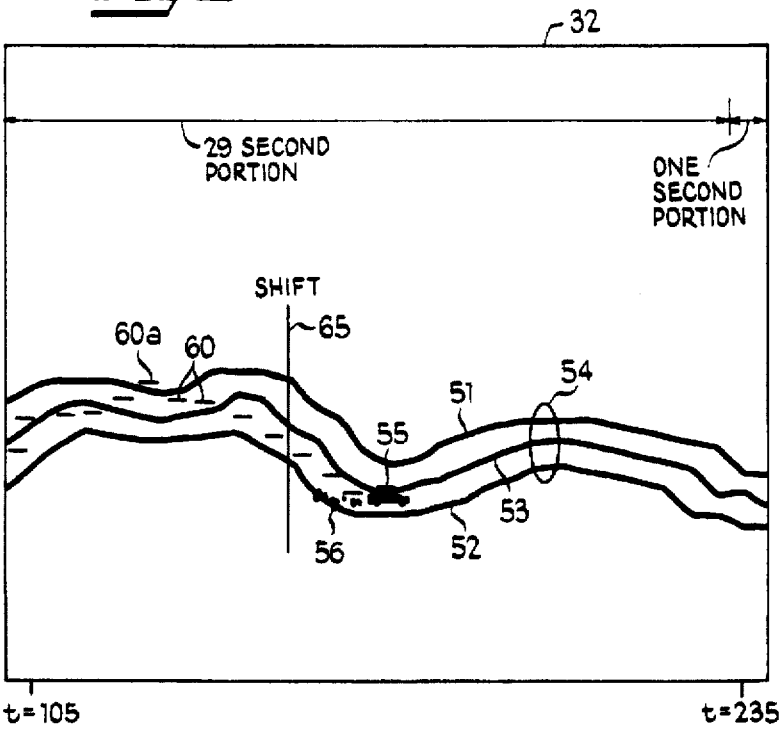
FIG. 3 shows a 30-second screen display presented to the technician at approximately the middle of the 240-second scrolling drive trace.
Figure 4:
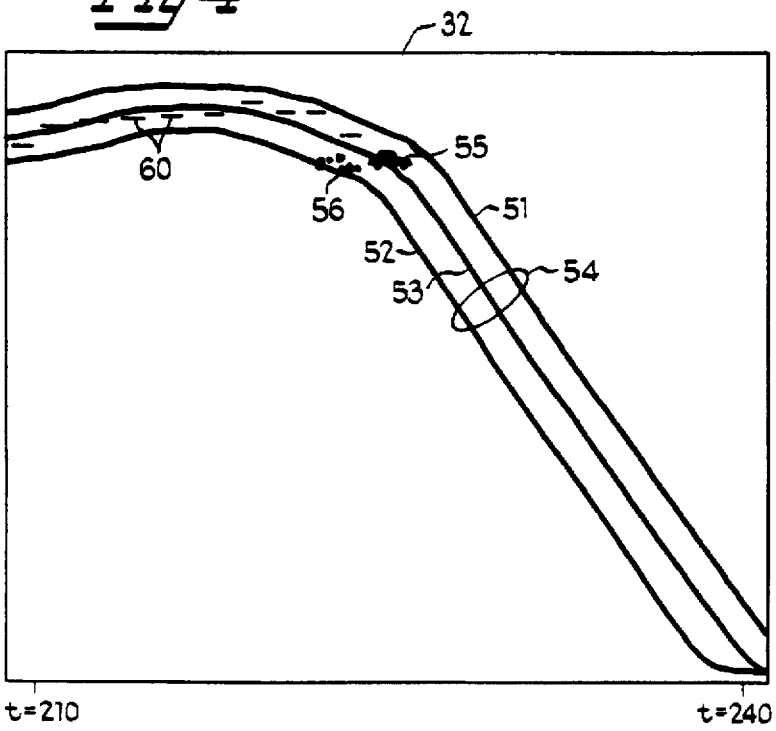
FIG. 4 shows the final 30-second screen display of the 240-second scrolling drive trace.

The scrolling drive-trace pattern represented in part by FIGS. 2–4 consists of an upper speed-limiting line 51, a lower speed-limiting line 52, and an ideal speed-indicating line 53. The lines 51 and 52 define a drive-trace band 54, the width of which is non-constant and varies in accordance with EPA guidelines setting forth a varying range of allowable vehicle speeds during each one-second time interval of the 240-second test period.

A generally polygon-shaped iconic marker 55 depicting a two-dimensional image of a car is used to graphically simulate the vehicle under test. The position of the marker 55 relative to the vertical axis of the screen 32 corresponds to the current speed of the vehicle in the appropriately selected units of measurement (e.g., kph or mph). Similarly, the position of the marker 55 relative to the horizontal axis of the screen 32 corresponds to the time-based position of the vehicle 10 as a function of the number of one-second time intervals elapsed since the beginning of the 240-second test. In the preferred embodiment, once the test is begun, a smoke-depicting icon 56 is drawn extending from the rear (left) of the iconic marker 55 to give a more appealing visual impression of forward (rightward) motion.

Initially, the technician is first presented with the 30-second drive trace display screen portion shown in FIG. 2. Referring to FIG. 2, the iconic marker 55 is shown in an initial position at time interval t=0 and at a vehicle speed of zero MPH (KPH). Once the emissions test is started, the technician will rely on the iconic marker 55 to aid him in maintaining the vehicle's speed within the range of allowable speeds depicted graphically by the band 54. Consequently, as the vehicle's speed is varied over time, the technician sees the marker 55 move horizontally to the right across the screen, once each second, and vertically, either upwardly or downwardly, as a function of the current speed of the vehicle at the particular time interval. The technician attempts to closely follow the drive-trace display in an effort to maintain the varying vehicle speed within allowable limits.

The moving marker 55 generates a trace line represented in the preferred embodiment by the hash marks 60. When vehicle speed deviates beyond narrowly defined limits, the iconic marker 55 moves outside the band 54 and changes color, instantly notifying the technician to take appropriate action (accelerate or decelerate). Hash mark 60*a*(FIG. 3) of the actual drive trace illustrates one instance where vehicle speed exceeded a maximum allowable value for a particular time interval.

In the event the vehicle 10 is of the manual transmission type, shift-indicating markers 65 will be generated guiding the technician to shift gears during appropriate intervals of the test.

During the first fifteen seconds of the test, the iconic marker moves both horizontally and vertically along the display screen 32. At the end of the first fifteen seconds of the test, the iconic marker 55 is graphically positioned about the horizontal center of the screen 32. For the succeeding one second interval of time and for the succeeding 210 one-second time intervals, the screen 32 will be scrolled to the left, once each second, so as to maintain the iconic marker in the horizontal center of the screen 32, as best seen by the later drive-trace pattern of FIG. 3. During this 210-second scrolling period, a moving, changing drive-trace is seen by the technician seated in the vehicle. The technician is aided in making necessary changes in the vehicle speed by the positional relationship of the horizontally-fixed iconic marker 55 and the oncoming, scrolling drive-trace band pattern 54.

Each corresponding one-second scrolled time interval involves deleting the 30-second drive trace currently displayed, redrawing the latter 29-second portion of the deleted 30-second display starting at the left-most edge of the screen 32 and appending to the right of the 29-second redrawn portion, the subsequent one-second drive-trace portion of the 240-second drive-trace.

At the end of the 210-second scrolling period (225 seconds since start), represented by the position of the iconic marker 55 in FIG. 4, scrolling will cease and the iconic marker will again begin to move horizontally across the screen 32 to a position to the rightmost half of the screen 32 (not shown) for the final fifteen one-second time intervals, at the end of which the 240-second drive trace is terminated.

In the illustrative embodiment, the scrolling procedure involves redrawing the 29-second portion of the previously displayed drive-trace pattern. For optimum scrolling, rather than recalculating the pixel position of the 29-second graph portion, which significantly burdens scrolling speed, the pixel information is temporarily stored in an assigned memory location and recalled during the redrawing step (but shifted by a one-second time interval position on the screen). The succeeding one-second interval drive-trace data, however, needs to be calculated by the analyzer circuitry and presented as pixel information to the screen 32.

The code for performing the various display and graphing functions is written in C-language, but another similar high-level language may be used instead. The graphing and scrolling of data, and the related features described above are easily carried out using the library of graphical interface software tools commercially available for the C language.

The initially displaced (non-scrolled) trace line pixel positions could also have been originally stored as tabularized data, rather than derived mathematically. However, the mathematically derived pixel positions provide additional system and display functionality, such as use of auto-scaling, zooming, window re-sizing and relocating, etc. all of which functions can be incorporated with the present invention, in a known manner, using the graphical interface tools commercially available for the C language.

One disadvantage of combining tabularized data (the redrawn 29-second data portion of the drive trace) with calculated data (the succeeding (30th) one-second interval position of the drive trace), is that, due to rounding errors in processing of the newly calculated data, the appended one-second interval drive-trace data sometimes unavoidably yields non-continuous vertical gaps between the end pixels of the 29-second portion and the start pixels of the appended one-second portion. The gaps are visually unappealing and it is suggested that it would be more visually appealing if both the last one-second interval of the redrawn portion and the appended one-second interval are calculated and simultaneously displayed along with the entire 29-second redrawn portion. To the extent there are unavoidable vertical gaps between the redrawn portion and the calculated portion, the 29-second time interval portion of the drive trace would consist of closely-spaced double lines, resulting in a more pleasing visual effect.

Figure 5:
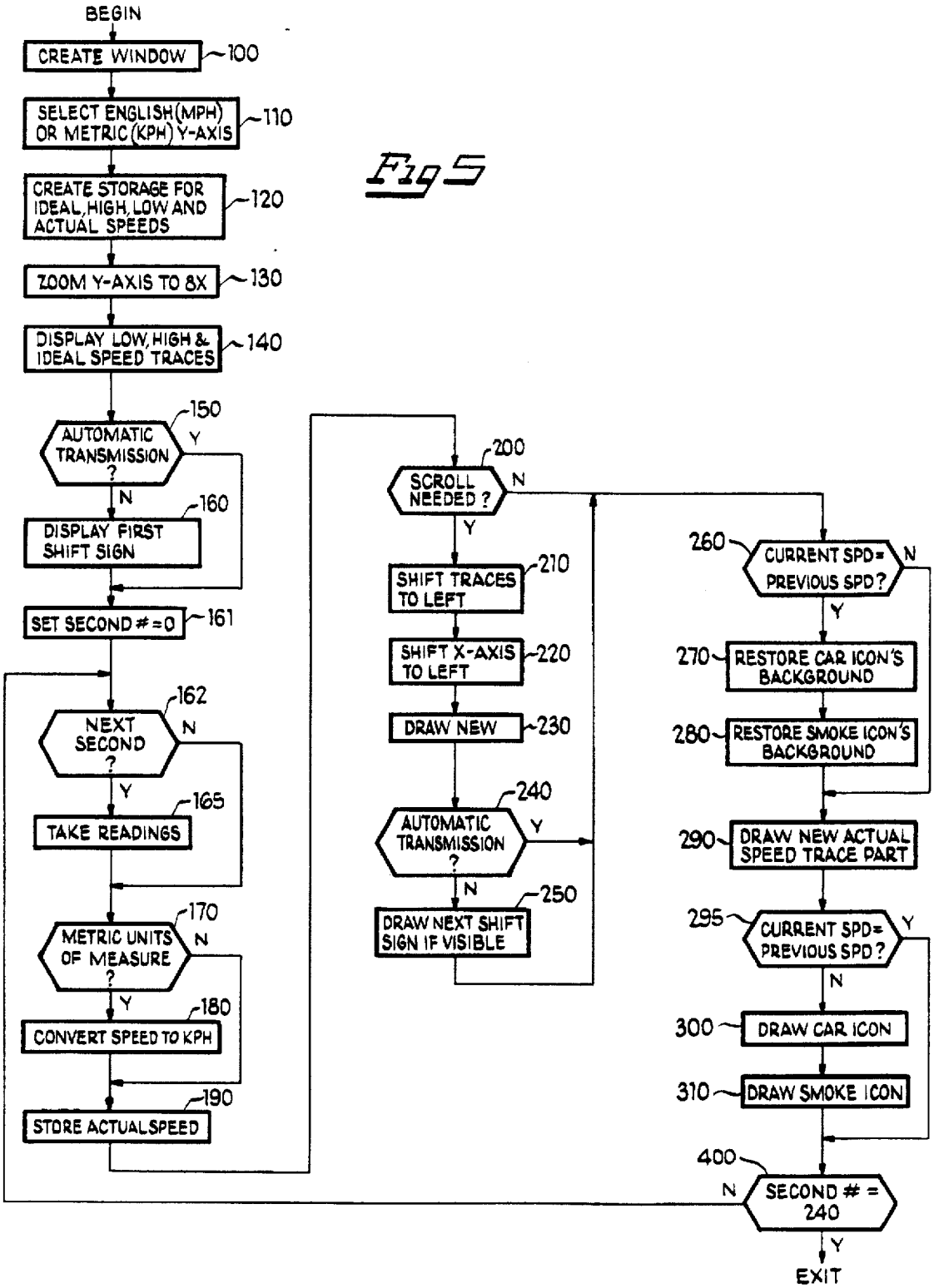
FIG. 5 is an operational flow chart of the method of generating the scrolling drive trace of FIGS. 2–4.

FIG. 5 is an operational flow chart of the method of generating the drive trace pattern of FIGS. 2–4. The emissions test is started by operator-entered initialization commands at the keyboard 33. The underlying program creates, as at 100, the window which will occupy the drive trace to be presented to the technician. Based on previously determined parameters, the program selects, at 110, appropriate units of vertical scaling (English:mph; metric:kph). Based on the selected units of scaling, memory assignments (120) are made for each of the ideal line, the high and low speed-limiting lines, and the actual speed line to be graphed. The initial 30-second drive trace display is then drawn with the horizontal axis scaled by a predetermined amount to yield maximum visual clarity (130, 140).

If the vehicle is not equipped with an automatic transmission, then appropriate shift markers 65 are drawn on the window, as at 150, 160.

At time interval t=0, the drive trace routine enters an initial loop, and a second-counting variable (second#) is set to zero, as at 161, corresponding to the beginning first-second time interval of the test. The second-counting variable is quizzed each time the loop is executed (162) and new speed vehicle readings taken if a second has elapsed since the last reading (165). Each time, the readings are evaluated (170), converted to appropriate units of measurement (180) and stored in memory (190). The routine then determines if the current time interval is one requiring scrolling (200) and if so, scrolls the display window (210–230) in the manner described above, including repositioning existing shift markers and adding new ones as appropriate (240–250).

At 260, the current actual speed of the vehicle is compared to the previous actual speed. If they are the same, then the car and smoke icon positions are determined, based on the current actual speed information, and then drawn on the drive trace display (270–280). If they are not the same, then after the appropriate actual speed trace hash line is drawn (290), the updated car and smoke icon positions are determined, based on the current actual speed information (295), and then drawn on the drive trace display (300–310). The above loop is repeated until the predetermined test time has been reached (400), at which time the routine is exited.

In summary, with the graphical interface of the present invention, the drive trace screen is magnified considerably horizontally, such that only a portion of the test period, e.g., a thirty second window, is visible on the analyzer monitor at any point in time. As time progresses, the screen is scrolled, for example every second, and the thirty second window is redrawn, appending thereto the drive trace screen associated with the subsequent one second interval. At the same time, the initial first second drive trace portion is wiped out from view.

In the preferred embodiment, the band 54 and iconic marker 55 scroll together with the drive trace screen. The iconic marker 55 provides a virtual representation to the technician of the current speed of the vehicle-under-test relative to the allowable upper and lower speed limits. As time progresses, the iconic marker 55 moves through the band. Optionally, should the technician's speed go outside the upper or lower limits (such as at hash line 60*a* in FIG. 3) defined by the scrolling band 54, the color of the iconic marker 55 (and/or the hash lines 60) will change immediately alerting the technician. Moreover, as the vehicle's speed is increased or decreased, the iconic marker 55 moves vertically to provide a virtual image to the technician of his current driving state.

It should be appreciated that scrolling the 240-second drive trace, in successive one-second time intervals, with each drive trace display presenting to the technician a 30-second window of drive trace information at any single instant in time, results in a drastically magnified (zoomed) drive trace that can be viewed easily from a distance and which, in effect, allows the technician to better anticipate upcoming changes in speed. The visual appearance of forward movement of the horizontally-centered iconic marker 55 through the drive trace band 54 results naturally from the once-a-second scrolling of the drive trace pattern.

It should be appreciated that the drive-trace graph could, optionally, be scrolled vertically. However, this is not preferred, since scrolling in both the horizontal and vertical directions might be too distracting for the technician.

It should further be understood that the circuitry for displaying the drive-trace graph (lines 51, 52, 53) and the iconic marker 55 on the screen 40 is well known in the art of video image processing and forms no part of the present invention. The screen 32 may be any conventional cathode-ray-tube (CRT) display device or any equivalent thereof having a sufficiently high pixel resolution to provide a crisp, easy-to-read scrolling drive-trace image.

Furthermore, because the pixel position of the graphically displayed data is calculated by appropriate math routines, the overall drive trace pattern can be easily resized or relocated on the screen 32, allowing multiple applications to be active and/or related data to be simultaneously displayed.

While particular embodiments of the present invention have been shown and described, it will be appreciated by those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A method of automatically generating a horizontally-magnified, scrolling drive-trace band on a graphical display screen of an engine analyzer to aid a technician in maintaining in real time a vehicle's speed within predefined limits over a fixed driving period of successive driving time intervals, the engine analyzer being coupled to receive speed-indicating signals indicative of the speed of the vehicle, the method comprising the steps of:

displaying an initial drive-trace band on the screen, the initial drive-trace band having varying width defined by a low speed-limiting line and a high speed-limiting line and representative of a range of allowable vehicle speeds during a first set of said successive driving time intervals, said first set defining a window of driving time less than the duration of said driving period;

displaying a movable iconic marker on the screen disposed within said initial drive-trace band, a vertical position of said iconic marker during an associated time interval being a function of the corresponding current vehicle speed;

moving said iconic marker horizontally on the screen after each elapsed time interval until said iconic marker reaches a predetermined position along said initial drive-trace band; and scrolling the initial drive-trace band after each elapsed time interval after said marker reaches said predetermined position along said initial drive-trace band by deleting a portion of a previous drive-trace band, redrawing the remaining drive-trace band on the screen shifted horizontally by a predetermined amount, and appending a new drive-trace band portion associated with a subsequent time interval to the remaining drive-trace band to create a scrolled drive-trace band after each elapsed time interval.

2. The method of claim 1, further comprising the step of drawing a shift indicating marker on the screen as an indication to the technician to manually shift the vehicle into a different gear.

3. The method of claim 1, wherein said iconic marker is a polygon-shaped image of a vehicle.

4. The method of claim 1, wherein said period is 240 seconds, said window of time is thirty seconds and the duration of each successive time interval is one second.

5. The method of claim 1, wherein said drive-trace band includes a third line, disposed between corresponding ones of said low and high speed-limiting lines, representative of an ideal vehicle speed during each associated time interval.

6. The method of claim 1, wherein the speed-indicating signals are generated by a dynamometer on which the vehicle is driven, said signals being representative of the real-time driving speed of the vehicle over the driving period.

7. A method of generating automatically a horizontally-magnified, scrolling drive-trace line on a graphical display screen of an engine analyzer to aid a technician in controlling in real time a vehicle's speed over a fixed driving period of successive driving time intervals, the engine analyzer being coupled to receive speed indicating signals indicative of the speed of the vehicle, the method comprising the steps of:

displaying an initial drive-trace line on the screen, the initial drive-trace line representing the ideal vehicle speed at which the technician should maintain the vehicle during a first set of successive driving time intervals, said first set defining a window of driving time less than the duration of said driving period;

displaying a movable iconic marker on the screen disposed along said displayed initial drive-trace line, a vertical position of said iconic marker during an associated time interval being a function of the corresponding current vehicle speed;

moving said iconic marker horizontally on the screen after each elapsed time interval until said iconic marker reaches a predetermined position along said initial drive-trace line; and scrolling the drive trace line after each elapsed time interval after said marker reaches said predetermined position along said initial drive-trace line by deleting a portion of a previous drive-trace line, redrawing the remaining drive-trace line on the screen shifted horizontally by a predetermined amount, and appending a new drive-trace line portion associated with a subsequent time interval to the remaining drive-trace line to create a scrolled drive-trace line after each elapsed time interval.

8. The method of claim 7, further comprising the step of drawing a shift indicating marker on the screen as an indication to the technician to manually shift the vehicle into a different gear.

9. The method of claim 7, wherein said iconic marker is a polygon-shaped image of a vehicle.

10. The method of claim 7, wherein said period is 240 seconds, said window of time is thirty seconds and the duration of each successive time interval is one second.

11. The method of claim 7, wherein the speed-indicating signals are generated by a dynamometer on which the vehicle is driven, said signals being representative of the real-time driving speed of the vehicle over the driving period.

12. An apparatus for automatically generating a horizontally-magnified, scrolling drive-trace band, the apparatus including a graphical display screen coupled to an engine analyzer of the type adapted to receive speed-indicating signals indicative of the speed of a vehicle, the drive-trace band aiding a technician in maintaining in real time a vehicle's speed within predefined limits over a fixed driving period of successive driving time intervals, comprising:

means for displaying an initial drive-trace band on the screen, the initial drive-trace band having varying width defined by a low speed-limiting line and a high speed-limiting line and representative of a range of allowable vehicle speed during a first set of said successive driving time intervals, said first set defining a window of driving time less than the duration of said driving period;

means for displaying a movable iconic marker on the screen disposed within said initial drive-trace band, a vertical position of said iconic marker during an associated time interval being a function of the corresponding current vehicle speed;

means for moving said iconic marker horizontally on the screen after each elapsed time interval until said iconic marker reaches a predetermined position along said initial drive-trace band; and means for scrolling the initial drive-trace band after each elapsed time interval after said marker reaches said predetermined position along said initial drive-trace band, said scrolling means including means for deleting a portion of a previous drive-trace band, means for redrawing the remaining drive-trace band on the screen shifted horizontally by a predetermined amount, and means for appending a new drive-trace band portion associated with a subsequent time interval to the remaining drive-trace band to create a scrolled drive-trace band after each elapsed time interval.

13. The apparatus of claim 12, further comprising means for drawing a shift indicating marker on the screen as an indication to the technician to manually shift the vehicle into a different gear.

14. The apparatus of claim 12, wherein said iconic marker is a polygon-shaped image of a vehicle.

15. The apparatus of claim 12, wherein said period is 240 seconds, said window of time is thirty seconds and the duration of each successive time interval is one second.

16. The apparatus of claim 12, wherein said drive-trace band includes a third line, disposed between corresponding ones of said low and high speed-limiting lines, representative of ideal vehicle speed during each associated time interval.

17. The apparatus of claim 12, wherein the vehicle is coupled to a dynamometer which generates said speed-indicating signals, the signals being representative of the real-time driving speed of the vehicle over the driving period.

18. An apparatus for automatically generating a horizontally-magnified, scrolling drive-trace line, the apparatus including a graphical display screen coupled to an engine analyzer of the type adapted to receive speed-indicating signals indicative of the speed of a vehicle, the drive trace line aiding a technician in controlling in real time the vehicle's speed over a fixed driving period of successive driving time intervals, the apparatus comprising:

means for displaying an initial drive-trace line on the screen, the initial drive-trace line representing the ideal vehicle speed at which the technician should maintain the vehicle during a first set of successive driving time intervals, said first set defining a window of driving time less than the duration of said driving period;

means for displaying a movable iconic marker on the screen disposed along said displayed initial drive-trace line, a vertical position of said iconic marker during an associated time interval being a function of corresponding current vehicle speed;

means for moving said iconic marker horizontally on the screen after each elapsed time interval until said iconic marker reaches a predetermined position along said initial drive-trace line; and means for scrolling the drive-trace line after each elapsed time interval after said marker reaches said predetermined position along said initial drive-trace line, said scrolling means having means for deleting a portion of a previous drive-trace line, means for redrawing the remaining drive-trace line on the screen shifted horizontally by a predetermined amount, and means for appending a new drive-trace line portion associated with a subsequent time interval to the remaining drive-trace line to create a scrolled drive-trace line after each elapsed time interval.

19. The apparatus of claim 18, further comprising means for drawing a shift indicating marker on the screen as an indication to the technician to manually shift the vehicle into a different gear.

20. The apparatus of claim 18, wherein said iconic marker is a polygon-shaped image of a vehicle.

21. The apparatus of claim 18, wherein said period is 240 seconds, said window of time is thirty seconds and the duration of each successive time interval is one second.

22. The apparatus of claim 18, wherein the vehicle is coupled to a dynamometer which generates said speed-indicating signals, the signal being representative of the real-time driving speed of the vehicle over the driving period.

* * * * *